US006006444A

United States Patent [19]

Bauböck et al.

[11] Patent Number: 6,006,444

[45] Date of Patent: Dec. 28, 1999

[54] PROCESS AND A DEVICE FOR REDUCING DUST DEPOSITS ON THE DRYING HOOD OR DUCT WORK OF A PAPER MACHINE

[75] Inventors: Jörg Bauböck, Graz; Robert Winkelbauer, Köflach; Wolfgang Promitzer, Graz, all of Austria

[73] Assignee: Andritz-Patentwaltungs-Gesellschaft m.b.H., Graz, Austria

[21] Appl. No.: 09/042,336

[22] Filed: Mar. 13, 1998

[30] Foreign Application Priority Data

Mar. 14, 1997 [AT] Austria ..... 442/97

[51] Int. Cl.[6] ..... F26B 3/04

[52] U.S. Cl. ..... 34/463; 34/114; 162/199

[58] Field of Search ..... 34/114, 115, 117, 34/119, 443, 444, 448, 451, 463; 15/306.1, 316.1, 317, 318, 318.1; 162/199, 272

[56] References Cited

U.S. PATENT DOCUMENTS

| | | | |
|---|---|---|---|
| 3,003,176 | 10/1961 | Goyette | 15/256.51 |
| 3,434,224 | 3/1969 | Blomgren et al. | 34/114 |
| 3,762,067 | 10/1973 | Whittaker et al. | 34/201 |
| 3,775,806 | 12/1973 | Olbrant et al. | 15/309.1 |
| 3,956,790 | 5/1976 | Ishiwata et al. | 15/302 |
| 4,019,953 | 4/1977 | Nystrom | 162/272 |
| 4,088,066 | 5/1978 | Bailey | 98/115 R |
| 4,523,390 | 6/1985 | McCarthy | 34/115 |
| 4,906,333 | 3/1990 | Myren | 162/111 |
| 5,635,031 | 6/1997 | Enkvist | 162/199 |
| 5,738,760 | 4/1998 | Svanqvist et al. | 162/193 |
| 5,800,679 | 9/1998 | Lindstrom et al. | 162/272 |

*Primary Examiner*—Pamela A. Wilson
*Attorney, Agent, or Firm*—Alix, Vale & Ristas, LLP

[57] ABSTRACT

The invention relates to a process for reducing dust deposits on the drying hood of a paper machine. It is primarily characterized by additional fresh air being blown over the upper side of the paper machine drying hood. The invention also relates to a device for reducing dust deposits on the drying hood of a paper machines, characterized by at least one slit for blowing our air being provided on the top side of the paper machine drying hood.

15 Claims, 3 Drawing Sheets

PROCESS AND A DEVICE FOR REDUCING DUST DEPOSITS ON THE DRYING HOOD OR DUCT WORK OF A PAPER MACHINE

BACKGROUND OF THE INVENTION

The present invention relates to a process and a device for reducing dust deposits on the drying hood of a paper machine.

In paper-making, and particularly in tissue production, a relatively large amount of dust is produced, which collects on all surfaces, particularly on the large horizontal surfaces of the drying hood of the paper machine and on the ductwork. Since these surfaces can become very hot in places, there are cases of glowing combustion from time to time, which cause loss of production. In intermittent cleaning processes which blow the dust off there is a risk of dust explosions being caused by dust particles becoming concentrated at jets of hot air escaping where there are leaks from the drying hood. Any practical consideration to date on the implementation of dust extraction techniques, relates only to cleaning dust off the paper web, but does not take any account of the effect this has on the surrounding area.

SUMMARY OF THE INVENTION

The invention, therefore, is aimed at creating a process and a device to substantially reduce the risk of fire and explosions attributable to the dust. According to the invention, this is achieved by additional fresh air being blown over the upper side of the paper machine drying hood and ductwork. This can prevent fine paper dust from collecting on the paper machine drying hood or on the machine's air circulating system.

An advantageous further development of the invention is characterized by the fresh air being blown in across the web running direction toward the drive side of the paper machine. This means that the operating personnel on the tender side of the paper machine are not seriously affected.

A favorable configuration of the invention is characterized by the amount of air blown being adjustable, with the blow direction also being adjustable as an alternative or as an additional feature. Since the amount and/or the direction can be adjusted, it is possible to adapt particularly well to special local conditions or conditions specific to a particular plant.

A favorable further development of the invention is characterized by more fresh air being blown onto the insulated surface of the expansion joints and/or ductwork.

The invention also refers to a device at a paper machine drying hood to reduce dust deposits. According to the invention, this device is characterized by at least one slit for blowing out air being provided on the top side of the paper machine drying hood, where it is an advantage to locate the slit in the insulating layer covering the hood.

A favorable further development of the invention is characterized by the at least one slit extending in the running direction of the machine.

An advantageous configuration of the invention is characterized by the slit openings being shaped such that the air is blown along the top side of the paper machine drying hood.

An advantageous further development of the invention is characterized by the slit for blowing out air being open toward the drive side of the paper machine.

A favorable configuration of the invention is characterized by the at least one slit for blowing out air having an adjustable cross-section, where the direction in which the slit blows the air can also be adjustable, either as an alternative or as an additional feature.

A favorable further development of the invention is characterized by the slit for blowing out air being provided in the insulating layer of a high-temperature hood of a tissue machine or, as an alternative, in the insulating layer of the machine hood of a multi-cylinder machine.

An advantageous configuration of the invention is characterized by the slit for blowing out air being connected to an air distribution system integrated into the insulating layer.

A special further development of the invention is characterized by the slit for blowing out air being provided in a duct mounted on the paper machine hood.

BRIEF DESCRIPTION OF THE DRAWINGS

The invention is described below in examples and with reference to the accompanying drawings, where.

DESCRIPTION OF THE PREFERRED EMBODIMENT

Figure 1:
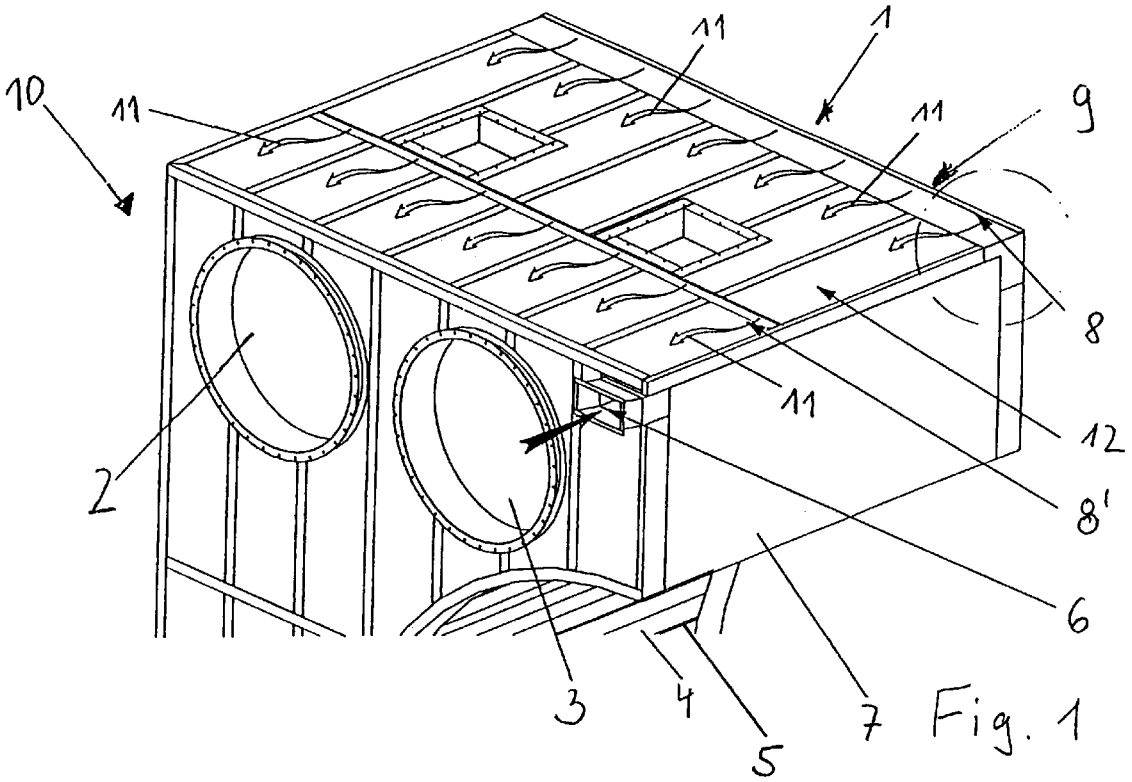
FIG. 1 shows a view of one half of a high-temperature hood for tissue machines.

The high temperature hood half 1 shown in FIG. 1 has a connection 2 for the fresh air supply duct for paper drying and a connection 3 for the exhaust air. Air is blown onto the paper through air discharge nozzles 4 and the air is extracted from the paper through slits 5. Another supply of fresh air is fed in through a connection piece 6. This connection piece 6 is connected to a distribution duct which is integrated into the insulating layer 7 of the high-temperature hood. The additional fresh air is then continuously blown out through a slit 8 located on the tender side 9 of the high-temperature hood 1. A further slit 8' for blowing out air, which helps to blow air toward the drive side 10 of the high-temperature hood 1, can also be provided. The air flows as indicated by the arrows 11 along the roof of the hood 12 toward the drive side 10. Thus, dust deposits can be avoided easily. As a result, fire protection in the plant undergoes considerable improvement. The cleaning intervals can also be extended and machine shutdowns for cleaning purposes can be shortened.

Figure 2:
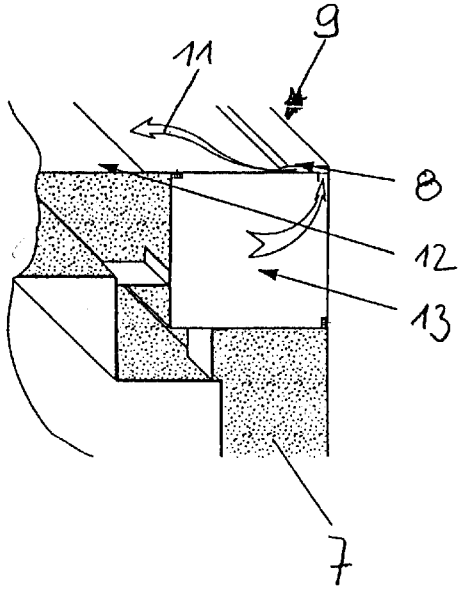
FIG. 2 shows a section from FIG. 1.

FIG. 2 shows a section from FIG. 1 containing a distribution duct 13 which is integrated into the insulating layer 7. The air from the air distribution duct 13 flows through the slit 8 for blowing out air on the tender side 9 of the high-temperature hood 1 along the roof 12 of the hood in the direction of the arrow 11 toward the drive side of the paper machine. The cross-section and direction of the slit for blowing out air can be adjustable here.

Thus, the amount of air blown out and the direction in which it flows can be influenced in order to obtain a well-directed air flow.

Figure 3:
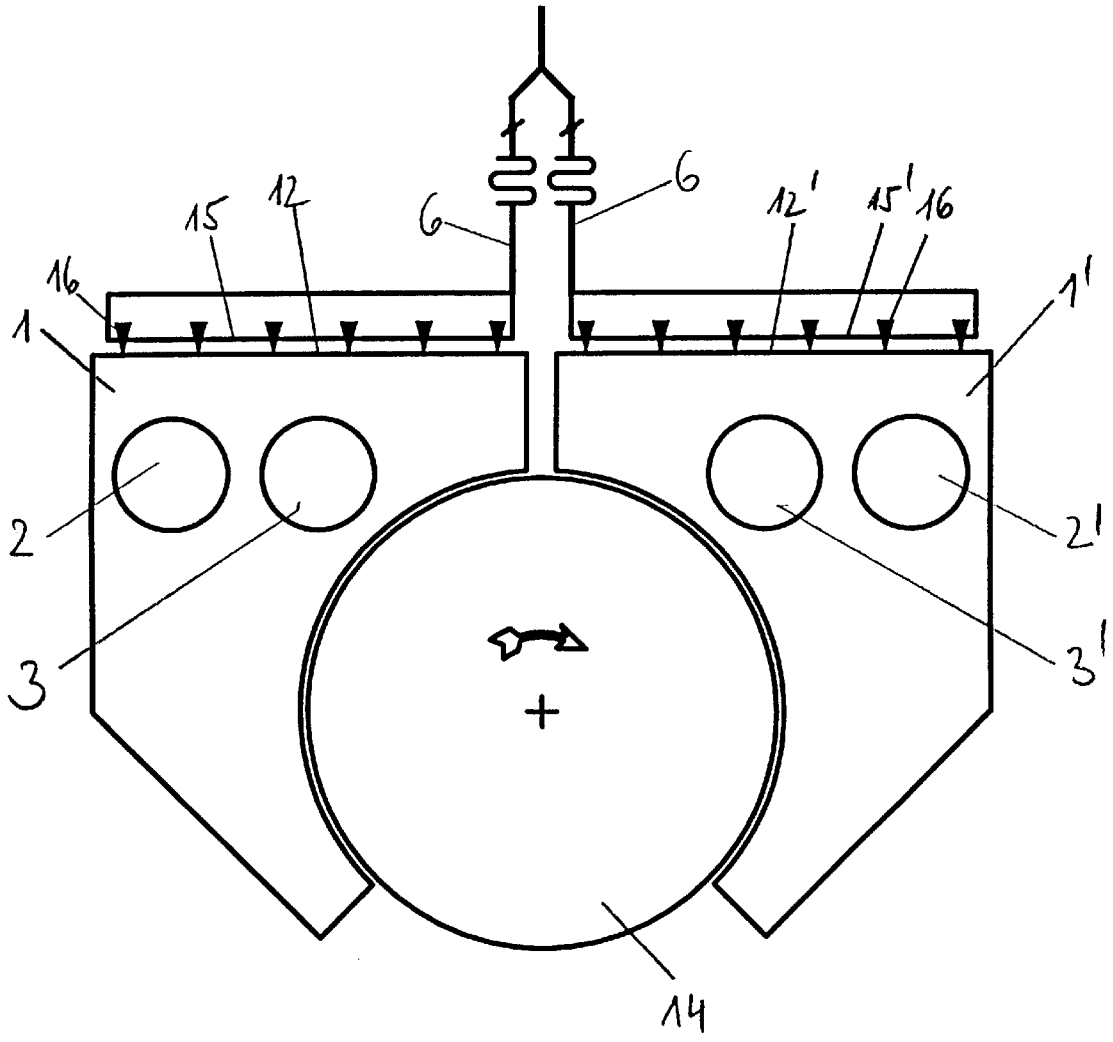
FIG. 3 provides a schematic view of a tissue machine with air blown onto the top side of the hood.

FIG. 3 shows a schematic view of a tissue machine with the hood halves 1, 1', mounted over the greater part of the circumference of the steam-heated drying cylinder 14. The air supply for drying is fed through the ducts 2,2' and the exhaust air is removed through ducts 3,3'. The air for blowing onto the top side 12, 12' of the hood is fed through ducts 6 and blown out through blow-out openings 16 of ducts 15, 15' mounted along the hood halves 1, 1'. These blow-out openings 16 can either take the form of holes or of slits.

Figure 4:
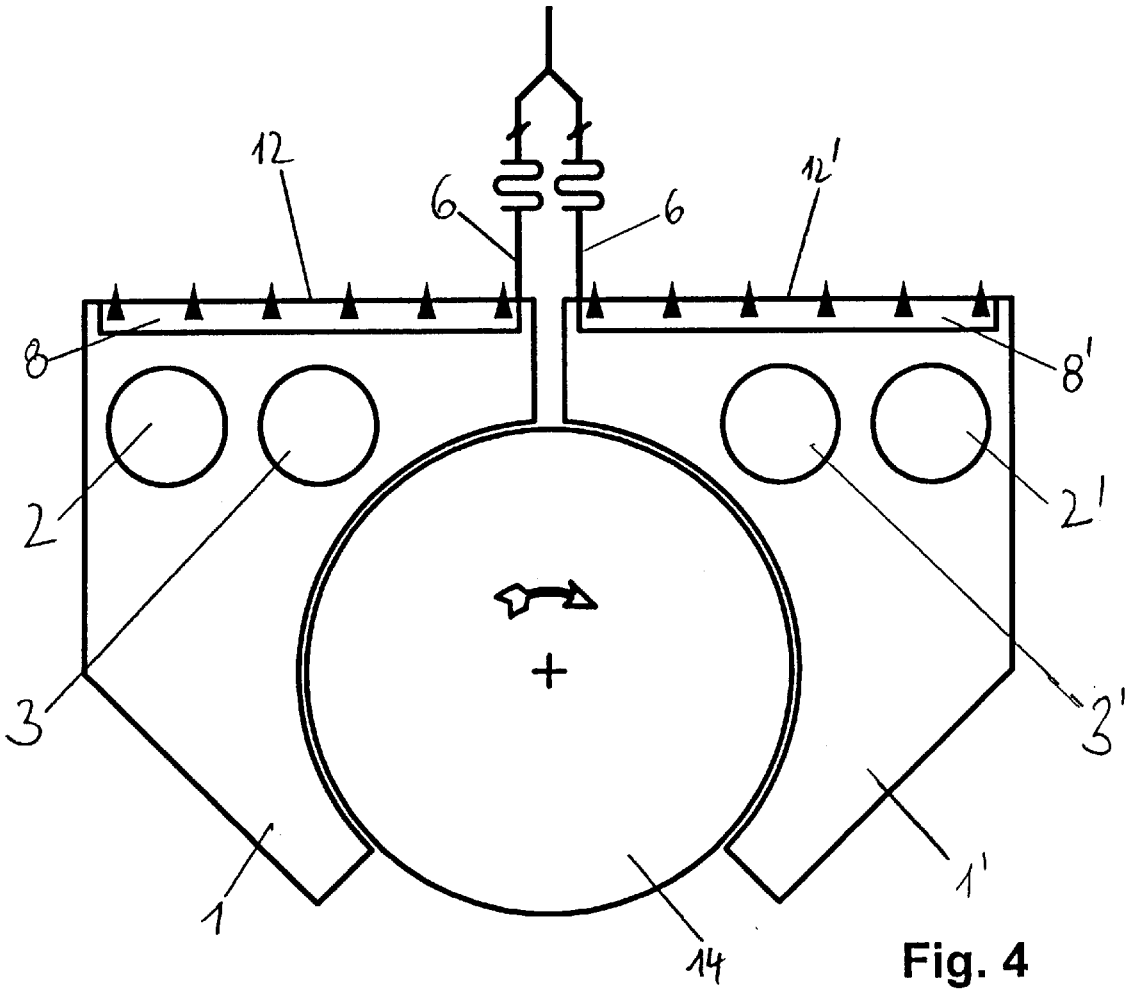
FIG. 4 contains a further variant of the invention analogous to FIG. 3 with integrated blow-out opening.

FIG. 4 contains a further variant of the invention analogous to FIG. 3, however with integrated blow-out openings. The illustration shows that the fresh air for blowing onto the hood is fed in through air distribution ducts and through the slits for blowing air 8, 8' integrated into the hood 1, 1'. These correspond to the ducts 13 and the slits for blowing out air 8 already illustrated in FIGS. 1 and 2.

Figure 5:
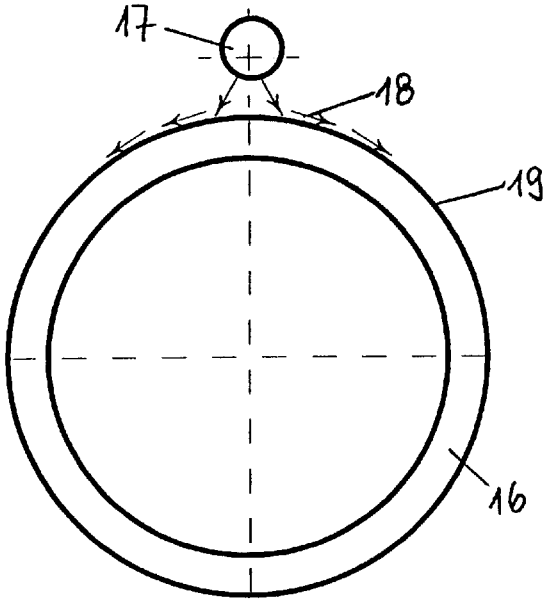
FIG. 5 illustrates how the invention is used at supply and exhaust air ducts to and from the hood.

FIG. 5 illustrates how the invention is used in supply and exhaust ducts to and from the hood. Here, a cross-section through a duct 20 is shown, where the fresh air for blowing onto the hood flows out of a duct 17 mounted above the supply and exhaust duct 20 along the surface 19 of the duct 20 according to the arrows 18. Thus, no dust can collect on these ducts.

We claim:

1. Process for reducing dust particles on the drying hood and duct work of a paper machine, wherein the improvement comprises continuously blowing fresh air over at least one of the drying hood and duct work for removing dust particles.

2. Process according to claim 1, comprising adjusting at least one of the amount and direction of blowing air.

3. In a paper machine drying hood having a drive side into which a fresh air supply is provided for paper drying, a tender side accessible by an operator, an upper side extending between the drive side and the tender side, a process for reducing dust deposits on the drying hood, comprising the step of blowing fresh air over the upper side of the drying hood, toward the drive side of the hood.

4. Process according to claim 3, comprising adjusting the direction of the air blown over the upper side of the drying hood.

5. Process according to claim 3, comprising adjusting the amount of the air blown over the upper side of the drying hood.

6. Process according to claim 3, wherein the drying hood includes insulation material and the fresh air is directed from the drive side through ducts situated in the insulation material, to distribution means at the upper side of the drying hood.

7. Process according to claim 3, wherein at least one clean air supply duct and at least one exhaust air removal duct are connected to the drying hood, and wherein said process includes continuously blowing fresh air onto the outer surface of at least one of said air supply duct or exhaust air removal duct.

8. In a paper making machine drying hood within which a paper web is moveable in a running direction for exposure to a flow of fresh air for paper drying, wherein said flow of fresh air enters the drying hood and said paper is dried within the drying hood, beneath a top side of the drying hood, the improvement for reducing dust deposits on the drying hood, comprising:

at least one distribution opening for blowing fresh air on the top side of the drying hood.

9. The improvement according to claim 8, wherein the distribution opening is an elongated slit.

10. The improvement according to claim 9, wherein the hood has an insulating layer with an exterior surface, and the slit is located in the exterior surface of the insulating layer and is connected to a fresh air distribution duct which is surrounded by the insulating layer.

11. The improvement according to claims 8, wherein the distribution opening includes at least one slit extending in said running direction.

12. The improvement according to claim 11, wherein each distribution opening is shaped such that the air is blown along the top side of the drying hood.

13. The improvement according to claim 8, wherein the distribution opening blows the air toward the drive side of the hood.

14. The improvement according to claim 8, wherein the drying hood is a high temperature hood of a tissue machine, the hood includes an insulating layer with exterior surface, the insulating layer surrounds a fresh air distribution duct, and the distribution opening includes a slit connected to the distribution duct and located in the exterior surface of the insulating layer.

15. The improvement according to claim 8, wherein a fresh air supply duct is mounted to the drying hood for paper drying, an additional fresh air supply duct is situated immediately above said fresh air duct, and means are provided for blowing fresh air from said additional duct, onto said fresh air duct.

* * * * *